US009475169B2

(12) United States Patent
Sung

(10) Patent No.: US 9,475,169 B2
(45) Date of Patent: *Oct. 25, 2016

(54) SYSTEM FOR EVALUATING AND/OR IMPROVING PERFORMANCE OF A CMP PAD DRESSER

(71) Applicant: Chien-Min Sung, Tansui (TW)

(72) Inventor: Chien-Min Sung, Tansui (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/223,726

(22) Filed: Mar. 24, 2014

(65) Prior Publication Data

US 2015/0072595 A1 Mar. 12, 2015

Related U.S. Application Data

(63) Continuation of application No. 12/850,747, filed on Aug. 5, 2010, now Pat. No. 8,678,878.

(60) Provisional application No. 61/246,816, filed on Sep. 29, 2009.

(51) Int. Cl.

| | |
|---|---|
| ***B24B 49/00*** | (2012.01) |
| ***B24D 18/00*** | (2006.01) |
| ***B24B 53/02*** | (2012.01) |
| ***B24B 1/00*** | (2006.01) |
| ***B24B 49/18*** | (2006.01) |

(Continued)

(52) U.S. Cl.

CPC ..... *B24B 49/186* (2013.01); *B24B 53/017* (2013.01); *B24D 3/28* (2013.01)

(58) Field of Classification Search

CPC ..... B24B 49/16; B24B 49/04; B24B 49/18; B24B 49/183; B24B 37/013; B24B 37/042; B24B 53/017; B24B 21/04; B24B 7/228

See application file for complete search history.

(56) References Cited

U.S. PATENT DOCUMENTS

| | | |
|---|---|---|
| 187,593 A | 2/1877 | Brown et al. |
| 238,946 A | 3/1881 | McKitrick |

(Continued)

FOREIGN PATENT DOCUMENTS

| | | |
|---|---|---|
| CN | 1351922 | 6/2002 |
| CN | 1494984 | 5/2004 |

(Continued)

OTHER PUBLICATIONS

Colmonoy Technical Data Sheet; No. DSP-A; 1993.

(Continued)

*Primary Examiner* — Dung Van Nguyen

(74) *Attorney, Agent, or Firm* — Thorpe North & Western LLP

(57) ABSTRACT

Methods and systems for evaluating and/or increasing CMP pad dresser performance are provided. In one aspect, for example, a method of identifying overly-aggressive superabrasive particles in a CMP pad dresser can include positioning a CMP pad dresser having a plurality of superabrasive particles on an indicator substrate such that at least a portion of the plurality of superabrasive particles of the CMP pad dresser contact the indicator substrate, and moving the CMP pad dresser across the indicator substrate in a first direction such that the portion of the plurality of superabrasive particles create a first marking pattern on the substrate, wherein the first marking pattern identifies a plurality of working superabrasive particles from among the plurality of superabrasive particles.

13 Claims, 1 Drawing Sheet

(51) Int. Cl.
*B24B 53/017* (2012.01)
*B24D 3/28* (2006.01)

(56) References Cited

U.S. PATENT DOCUMENTS

| | | | |
|---|---|---|---|
| 296,756 | A | 4/1884 | Kirkpatrick |
| 1,854,071 | A | 4/1932 | Schacht |
| 1,988,065 | A | 1/1935 | Wooddell |
| 2,027,087 | A | 1/1936 | Buckner |
| 2,027,307 | A | 1/1936 | Schacht |
| 2,033,991 | A | 3/1936 | Melton |
| 2,035,521 | A | 3/1936 | Benner |
| 2,075,354 | A | 3/1937 | Monier |
| 2,078,354 | A | 4/1937 | Webster |
| RE20,660 | E | 2/1938 | Schacht |
| 2,184,348 | A | 12/1939 | Kirchner |
| 2,187,624 | A | 1/1940 | Melton |
| 2,194,253 | A | 3/1940 | Benner |
| 2,268,663 | A | 1/1942 | Kuzmick |
| 2,281,558 | A | 5/1942 | Cross |
| 2,307,461 | A | 1/1943 | Ogden |
| 2,318,570 | A | 5/1943 | Paul |
| 2,334,572 | A | 11/1943 | Melton |
| 2,612,348 | A | 9/1952 | Catallo |
| 2,652,951 | A | 9/1953 | Augustus |
| 2,725,693 | A | 12/1955 | Leigh |
| 2,811,960 | A | 11/1957 | Fessel |
| 2,867,086 | A | 1/1959 | Haley |
| 2,876,086 | A | 3/1959 | Raymond |
| 2,947,608 | A | 8/1960 | Hall |
| 2,952,951 | A | 9/1960 | Simpson |
| 3,067,551 | A | 12/1962 | Maginnis |
| 3,121,981 | A | 2/1964 | Hurst |
| 3,127,715 | A | 4/1964 | Christensen |
| 3,146,560 | A | 9/1964 | Hurst |
| 3,276,852 | A | 10/1966 | Lemelson |
| 3,293,012 | A | 12/1966 | Smiley |
| 3,372,010 | A | 3/1968 | Parsons |
| 3,377,411 | A | 4/1968 | Charvat |
| 3,416,560 | A | 12/1968 | Bruno |
| 3,440,774 | A | 4/1969 | Curn |
| 3,593,382 | A | 7/1971 | Miller |
| 3,608,134 | A | 9/1971 | Cook |
| 3,625,666 | A | 12/1971 | James |
| 3,630,699 | A | 12/1971 | Caitlin |
| 3,631,638 | A | 1/1972 | Yoshikawa et al. |
| 3,664,662 | A | 5/1972 | Linz |
| 3,706,650 | A | 12/1972 | Eisner |
| 3,743,489 | A | 7/1973 | Wentorf, Jr. et al. |
| 3,767,371 | A | 10/1973 | Wentorf, Jr. et al. |
| 3,802,130 | A | 4/1974 | Lindenbeck |
| 3,819,814 | A | 6/1974 | Pope |
| 3,852,078 | A | 12/1974 | Wakatsuki et al. |
| 3,894,673 | A | 7/1975 | Lowder et al. |
| 3,905,571 | A | 9/1975 | Lombardo |
| 3,982,358 | A | 9/1976 | Fukuda |
| 4,018,576 | A | 4/1977 | Lowder et al. |
| 4,028,576 | A | 6/1977 | Wofsey |
| 4,078,906 | A | 3/1978 | Green |
| 4,149,881 | A | 4/1979 | D'Silva |
| 4,151,154 | A | 4/1979 | Berger |
| 4,155,721 | A | 5/1979 | Fletcher |
| 4,182,628 | A | 1/1980 | D'Silva |
| 4,188,194 | A | 2/1980 | Corrigan |
| 4,201,601 | A | 5/1980 | D'Silva |
| 4,211,294 | A | 7/1980 | Multakh |
| 4,211,924 | A | 7/1980 | Müller et al. |
| 4,224,380 | A | 9/1980 | Bovenkerek et al. |
| 4,228,214 | A | 10/1980 | Steigleman et al. |
| 4,229,186 | A | 10/1980 | Wilson |
| 4,273,561 | A | 6/1981 | Fernandez-Moran Villalobos |
| 4,287,168 | A | 9/1981 | Wentorf et al. |
| 4,289,503 | A | 9/1981 | Corrigan |
| 4,341,532 | A | 7/1982 | Oide |
| 4,355,489 | A | 10/1982 | Heyer et al. |
| 4,405,411 | A | 9/1983 | Inoue et al. |
| 4,481,016 | A | 11/1984 | Campbell et al. |
| 4,525,179 | A | 6/1985 | Gigl |
| 4,547,257 | A | 10/1985 | Iizuka et al. |
| 4,551,195 | A | 11/1985 | Iizuka et al. |
| 4,565,034 | A | 1/1986 | Sekiya |
| 4,610,699 | A | 9/1986 | Yazu et al. |
| 4,617,181 | A | 10/1986 | Yazu et al. |
| 4,629,373 | A | 12/1986 | Hall |
| 4,632,817 | A | 12/1986 | Yazu et al. |
| 4,662,896 | A | 5/1987 | Dennis |
| 4,669,522 | A | 6/1987 | Griffin |
| 4,680,199 | A | 7/1987 | Vontell et al. |
| 4,712,552 | A | 12/1987 | Pangburn |
| 4,737,162 | A | 4/1988 | Grazen |
| 4,749,514 | A | 6/1988 | Murakami et al. |
| 4,770,907 | A | 9/1988 | Kimura |
| 4,776,861 | A | 10/1988 | Frushour |
| 4,780,274 | A | 10/1988 | Barr |
| 4,797,241 | A | 1/1989 | Peterson et al. |
| 4,828,582 | A | 5/1989 | Frushour |
| 4,849,602 | A | 7/1989 | Gardner |
| 4,863,573 | A | 9/1989 | Moore et al. |
| 4,866,888 | A | 9/1989 | Murai et al. |
| 4,883,500 | A | 11/1989 | Deakins et al. |
| 4,908,046 | A | 3/1990 | Wiand |
| 4,916,869 | A | 4/1990 | Oliver |
| 4,923,490 | A | 5/1990 | Johnson et al. |
| 4,925,457 | A | 5/1990 | deKok et al. |
| 4,927,619 | A | 5/1990 | Tsuji |
| 4,943,488 | A | 7/1990 | Sung et al. |
| 4,945,686 | A | 8/1990 | Wiand |
| 4,949,511 | A | 8/1990 | Endo et al. |
| 4,954,139 | A | 9/1990 | Cerutti |
| 4,968,326 | A | 11/1990 | Wiand |
| 5,000,273 | A | 3/1991 | Horton et al. |
| 5,011,513 | A | 4/1991 | Zador et al. |
| 5,022,895 | A | 6/1991 | Wiand |
| 5,024,680 | A | 6/1991 | Chen et al. |
| 5,030,276 | A | 7/1991 | Sung et al. |
| 5,037,451 | A | 8/1991 | Burnand et al. |
| 5,043,120 | A | 8/1991 | Corrigan |
| 5,049,165 | A | 9/1991 | Tselesin |
| 5,092,082 | A | 3/1992 | Padberg |
| 5,092,910 | A | 3/1992 | deKok et al. |
| 5,116,568 | A | 5/1992 | Sung |
| 5,131,924 | A | 7/1992 | Wiand |
| 5,133,782 | A | 7/1992 | Wiand |
| 5,137,543 | A | 8/1992 | Heath et al. |
| 5,151,107 | A | 9/1992 | Cho et al. |
| 5,164,247 | A | 11/1992 | Solanki et al. |
| 5,176,155 | A | 1/1993 | Rudolph, Jr. |
| 5,190,568 | A | 3/1993 | Tselesin |
| 5,194,070 | A | 3/1993 | Sumiya et al. |
| 5,194,071 | A | 3/1993 | Corrigan et al. |
| 5,195,403 | A | 3/1993 | Sani et al. |
| 5,195,404 | A | 3/1993 | Notter et al. |
| 5,197,249 | A | 3/1993 | Wiand |
| 5,203,881 | A | 4/1993 | Wiand |
| 5,232,320 | A | 8/1993 | Tank et al. |
| 5,243,790 | A | 9/1993 | Gagne |
| 5,246,884 | A | 9/1993 | Jaso |
| 5,247,765 | A | 9/1993 | Quintana |
| 5,248,317 | A | 9/1993 | Tank |
| 5,264,011 | A | 11/1993 | Brown et al. |
| 5,266,236 | A | 11/1993 | Bovenkerk |
| 5,271,547 | A | 12/1993 | Carlson |
| 5,273,730 | A | 12/1993 | Yoshida et al. |
| 5,295,402 | A | 3/1994 | Bovenkerk |
| 5,314,513 | A | 5/1994 | Miller |
| 5,328,548 | A | 7/1994 | Tsuji et al. |
| 5,364,423 | A | 11/1994 | Bigelow et al. |
| 5,374,293 | A | 12/1994 | Takashita et al. |
| 5,380,390 | A | 1/1995 | Tselesin |
| 5,443,032 | A | 8/1995 | Vichr et al. |
| 5,453,106 | A | 9/1995 | Roberts |
| 5,454,343 | A | 10/1995 | Eun et al. |
| 5,458,754 | A | 10/1995 | Sathrum et al. |
| 5,486,131 | A | 1/1996 | Cesna et al. |

(56) References Cited

U.S. PATENT DOCUMENTS 5,492,771 A 2/1996 Lowder et al.
5,492,774 A 2/1996 Tateno
5,496,386 A 3/1996 Broberg et al.
5,500,248 A 3/1996 Iacovangelo et al.
5,505,272 A 4/1996 Clark
5,518,443 A 5/1996 Fisher
5,527,424 A 6/1996 Mullins
5,536,202 A 7/1996 Appel et al.
5,547,417 A 8/1996 Breivogel et al.
5,551,959 A 9/1996 Martin et al.
5,560,745 A 10/1996 Roberts
5,560,754 A 10/1996 Johnson et al.
5,609,286 A 3/1997 Anthon
5,620,489 A 4/1997 Tselesin
5,660,894 A 8/1997 Chen et al.
5,669,943 A 9/1997 Horton et al.
5,674,572 A 10/1997 Sarin et al.
5,725,421 A 3/1998 Goers et al.
5,746,931 A 5/1998 Graebner
RE35,812 E 6/1998 Oliver
5,772,756 A 6/1998 Davies et al.
5,776,214 A 7/1998 Wood
5,779,743 A 7/1998 Wood
5,791,975 A 8/1998 Cesna et al.
5,801,073 A 9/1998 Robbins et al.
5,816,891 A 10/1998 Woo
5,820,450 A 10/1998 Calhoun
5,833,519 A 11/1998 Moore
5,840,090 A 11/1998 Ho et al.
5,851,138 A 12/1998 Hempel, Jr.
5,855,314 A 1/1999 Shiue et al.
5,868,806 A 2/1999 Nishio et al.
5,885,137 A 3/1999 Ploessl
5,902,173 A 5/1999 Tanaka
5,916,011 A 6/1999 Kim et al.
5,919,084 A 7/1999 Powell et al.
5,921,856 A * 7/1999 Zimmer ..... 451/539
5,924,917 A 7/1999 Benedict et al.
5,961,373 A 10/1999 Lai
5,975,988 A 11/1999 Christianson
5,976,001 A 11/1999 Powell et al.
5,976,205 A 11/1999 Andrews et al.
5,980,852 A 11/1999 Gurns et al.
5,980,982 A 11/1999 Degawa et al.
5,985,228 A 11/1999 Corrigan et al.
6,001,008 A 12/1999 Fujimori et al.
6,001,174 A 12/1999 Fang
6,024,824 A 2/2000 Krech
6,027,659 A 2/2000 Billett
6,030,595 A 2/2000 Sumiya et al.
6,039,641 A 3/2000 Sung
6,054,183 A 4/2000 Zimmer et al.
6,093,280 A 7/2000 Kirchner et al.
6,106,382 A 8/2000 Sakaguchi
6,123,612 A 9/2000 Goers
6,125,612 A 10/2000 Main
6,159,087 A 12/2000 Briang et al.
6,159,286 A 12/2000 Sung
6,179,886 B1 1/2001 Gordeev et al.
6,190,240 B1 2/2001 Kinoshita et al.
6,193,770 B1 2/2001 Sung
6,196,911 B1 3/2001 Preston et al.
6,200,360 B1 3/2001 Imai et al.
6,206,942 B1 3/2001 Wood et al.
6,213,856 B1 4/2001 Cho et al.
6,217,413 B1 4/2001 Christianson
6,224,469 B1 5/2001 Ohmori et al.
6,258,138 B1 7/2001 DeVoe et al.
6,258,201 B1 7/2001 Krech
6,258,237 B1 7/2001 Gal-Or et al.
6,281,129 B1 8/2001 Easter et al.
6,284,556 B1 9/2001 Wang et al.
6,286,498 B1 9/2001 Sung
6,293,854 B1 9/2001 Kimura et al.
6,299,508 B1 10/2001 Gagliardi et al.
6,299,521 B1 10/2001 Morimura et al.
6,312,324 B1 11/2001 Mitsui et al.
6,319,108 B1 11/2001 Adefris et al.
6,325,709 B1 12/2001 Nanda et al.
6,346,202 B1 2/2002 Molnar
6,354,918 B1 3/2002 Togawa et al.
6,354,929 B1 3/2002 Adefris et al.
6,368,198 B1 4/2002 Sung et al.
6,371,838 B1 4/2002 Holzapfel
6,371,842 B1 4/2002 Romero
6,372,001 B1 4/2002 Omar et al.
6,394,886 B1 5/2002 Chen et al.
6,409,580 B1 6/2002 Lougher et al.
6,416,878 B2 7/2002 An
6,439,986 B1 8/2002 Myoung et al.
6,446,740 B2 9/2002 Eyre
6,458,018 B1 10/2002 Goers et al.
6,478,831 B2 11/2002 Tselesin
6,497,853 B1 12/2002 Davies et al.
6,524,523 B1 2/2003 Jeng et al.
6,544,599 B1 4/2003 Brown et al.
6,551,176 B1 4/2003 Garretson
6,605,798 B1 8/2003 Cullen
6,607,423 B1 8/2003 Areayan et al.
6,616,725 B2 9/2003 Cho et al.
6,616,752 B1 9/2003 Basura
6,626,167 B2 9/2003 Kim et al.
6,627,168 B1 9/2003 Ohtsubo et al.
6,629,884 B1 10/2003 Goers
6,646,725 B1 11/2003 Eichinger
6,672,943 B2 1/2004 Vogtmann
6,679,243 B2 1/2004 Sung
6,692,547 B2 2/2004 Kim
6,694,847 B2 2/2004 Hiroyasu et al.
6,722,952 B2 4/2004 Goers et al.
6,749,485 B1 6/2004 James et al.
6,755,720 B1 6/2004 Ishizaki et al.
6,769,969 B1 8/2004 Duescher
6,790,126 B2 9/2004 Wood et al.
6,818,029 B2 11/2004 Myoung et al.
6,824,455 B2 11/2004 Osterheld et al.
6,835,365 B1 12/2004 Davies et al.
6,837,979 B2 1/2005 Uzho et al.
6,884,155 B2 4/2005 Sung et al.
6,899,592 B1 5/2005 Kojima et al.
6,905,571 B2 6/2005 Sakuma et al.
6,935,365 B2 8/2005 Schuster
6,945,857 B1 9/2005 Doan et al.
6,979,357 B2 12/2005 Fries et al.
7,021,995 B2 4/2006 Toge et al.
7,033,408 B2 4/2006 Fries et al.
7,044,990 B2 5/2006 Ishizaki et al.
7,066,795 B2 6/2006 Balagani et al.
7,067,903 B2 6/2006 Tachibana et al.
7,124,753 B2 10/2006 Sung
7,150,677 B2 12/2006 Yamashita et al.
7,198,553 B2 4/2007 Goers
7,201,645 B2 4/2007 Sung
7,247,577 B2 7/2007 Palmgren et al.
7,258,708 B2 8/2007 Sung
7,261,621 B2 8/2007 Moon et al.
7,323,049 B2 1/2008 Sung
7,368,013 B2 5/2008 Sung
7,384,436 B2 6/2008 Sung
7,393,264 B1 * 7/2008 Sung ..... 451/41
7,404,857 B2 7/2008 Sung
7,465,217 B2 12/2008 Kinoshita et al.
7,473,162 B1 * 1/2009 Sung et al. ..... 451/21
7,494,404 B2 * 2/2009 Sung ..... 451/527
7,507,267 B2 3/2009 Hall et al.
7,585,366 B2 9/2009 Sung
7,641,538 B2 1/2010 Goers
7,651,368 B2 1/2010 Kendall et al.
7,651,386 B2 1/2010 Sung
7,658,666 B2 2/2010 Sung
7,690,971 B2 4/2010 Sung
7,762,872 B2 7/2010 Sung
7,791,188 B2 9/2010 Sung
7,840,305 B2 11/2010 Behr et al.

(56) References Cited

U.S. PATENT DOCUMENTS

| | | | |
|---|---|---|---|
| 7,954,483 | B2 | 6/2011 | Kim et al. |
| 8,104,464 | B2 | 1/2012 | Sung |
| 8,377,158 | B2 | 2/2013 | Palmgren et al. |
| 8,393,934 | B2 | 3/2013 | Sung |
| 8,398,466 | B2 | 3/2013 | Sung et al. |
| 8,545,583 | B2 | 10/2013 | Duescher |
| 8,678,878 | B2 * | 3/2014 | Sung ..... 451/8 |
| 8,777,699 | B2 | 7/2014 | Sung |
| 2001/0003884 | A1 | 6/2001 | Wei et al. |
| 2001/0009844 | A1 | 7/2001 | Cho et al. |
| 2001/0046835 | A1 | 11/2001 | Wielonski et al. |
| 2002/0014041 | A1 | 2/2002 | Baldonai et al. |
| 2002/0042200 | A1 | 4/2002 | Fawcett |
| 2002/0127962 | A1 | 9/2002 | Cho et al. |
| 2002/0139680 | A1 | 10/2002 | George |
| 2002/0164928 | A1 | 11/2002 | Tolles |
| 2002/0173234 | A1 | 11/2002 | Sung et al. |
| 2002/0182401 | A1 | 12/2002 | Lawing |
| 2003/0054746 | A1 | 3/2003 | Nussbaumer et al. |
| 2003/0084894 | A1 | 5/2003 | Sung |
| 2003/0092357 | A1 | 5/2003 | Yoon et al. |
| 2003/0114094 | A1 | 6/2003 | Myoung et al. |
| 2003/0207659 | A1 | 11/2003 | Annen et al. |
| 2004/0009742 | A1 | 1/2004 | Lin et al. |
| 2004/0023610 | A1 | 2/2004 | Hu et al. |
| 2004/0060243 | A1 | 4/2004 | Fries et al. |
| 2004/0079033 | A1 | 4/2004 | Long |
| 2004/0091627 | A1 | 5/2004 | Ohara et al. |
| 2004/0107648 | A1 | 6/2004 | Sung |
| 2004/0112359 | A1 | 6/2004 | Sung |
| 2004/0180617 | A1 | 9/2004 | Goers |
| 2004/0185763 | A1 | 9/2004 | Ishizaki et al. |
| 2004/0203325 | A1 | 10/2004 | Donohue |
| 2004/0235406 | A1 | 11/2004 | Duescher |
| 2004/0238946 | A1 | 12/2004 | Tachibana et al. |
| 2005/0032462 | A1 | 2/2005 | Gagliardi et al. |
| 2005/0032469 | A1 | 2/2005 | Duescher |
| 2005/0060941 | A1 | 3/2005 | Provow |
| 2005/0095959 | A1 | 5/2005 | Sung |
| 2005/0118939 | A1 | 6/2005 | Duescher |
| 2005/0215188 | A1 | 9/2005 | Toge et al. |
| 2005/0227590 | A1 | 10/2005 | Sung |
| 2005/0260939 | A1 | 11/2005 | Andrews et al. |
| 2006/0073774 | A1 | 4/2006 | Sung |
| 2006/0079160 | A1 | 4/2006 | Balagani et al. |
| 2006/0079162 | A1 | 4/2006 | Yamashita et al. |
| 2006/0128288 | A1 | 6/2006 | An et al. |
| 2006/0135050 | A1 | 6/2006 | Petersen et al. |
| 2006/0143991 | A1 | 7/2006 | Sung |
| 2006/0213128 | A1 | 9/2006 | Sung |
| 2006/0254154 | A1 | 11/2006 | Huang et al. |
| 2006/0258276 | A1 | 11/2006 | Sung |
| 2007/0051354 | A1 | 3/2007 | Sung |
| 2007/0051355 | A1 | 3/2007 | Sung |
| 2007/0060026 | A1 | 3/2007 | Sung |
| 2007/0066194 | A1 | 3/2007 | Wielonski et al. |
| 2007/0093181 | A1 | 4/2007 | Lugg et al. |
| 2007/0128994 | A1 | 6/2007 | Sung |
| 2007/0155298 | A1 | 7/2007 | Sung |
| 2007/0232074 | A1 | 10/2007 | Ravi et al. |
| 2007/0249270 | A1 | 10/2007 | Sung |
| 2007/0254566 | A1 | 11/2007 | Sung |
| 2007/0264918 | A1 | 11/2007 | Sung |
| 2007/0266639 | A1 | 11/2007 | Sung |
| 2007/0295267 | A1 | 12/2007 | Sung |
| 2008/0014845 | A1 | 1/2008 | Yimaz et al. |
| 2008/0076338 | A1 | 3/2008 | Andrews et al. |
| 2008/0096479 | A1 | 4/2008 | Sung |
| 2008/0153398 | A1 | 6/2008 | Sung |
| 2008/0171503 | A1 | 7/2008 | Sung |
| 2008/0271384 | A1 * | 11/2008 | Puthanangady et al. ..... 51/309 |
| 2008/0292869 | A1 | 11/2008 | Sung |
| 2008/0296756 | A1 | 12/2008 | Koch et al. |
| 2009/0068937 | A1 | 3/2009 | Sung |
| 2009/0073774 | A1 | 3/2009 | Horesh |
| 2009/0093195 | A1 | 4/2009 | Sung |
| 2009/0094902 | A1 | 4/2009 | Hou |
| 2009/0123705 | A1 | 5/2009 | Sung |
| 2009/0145045 | A1 | 6/2009 | Sung |
| 2009/0215363 | A1 | 8/2009 | Sung |
| 2009/0283089 | A1 | 11/2009 | Sung |
| 2010/0015898 | A1 | 1/2010 | An et al. |
| 2010/0022174 | A1 | 1/2010 | Chou et al. |
| 2010/0139174 | A1 | 6/2010 | Sung |
| 2010/0186479 | A1 | 7/2010 | Borucki et al. |
| 2010/0203811 | A1 | 8/2010 | Philipossian et al. |
| 2010/0221990 | A1 | 9/2010 | Sung |
| 2010/0248595 | A1 | 9/2010 | Dinh-Ngoc et al. |
| 2010/0248596 | A1 | 9/2010 | Sung |
| 2010/0261419 | A1 | 10/2010 | Sung |
| 2010/0273402 | A1 | 10/2010 | Shimizu |
| 2011/0076925 | A1 | 3/2011 | Sung |
| 2011/0104989 | A1 | 5/2011 | Boutaghou et al. |
| 2011/0192652 | A1 | 8/2011 | Shen et al. |
| 2011/0212670 | A1 | 9/2011 | Sung |
| 2011/0252710 | A1 | 10/2011 | Hall et al. |
| 2011/0275288 | A1 | 11/2011 | Sung |
| 2011/0293905 | A1 | 12/2011 | Sung |
| 2011/0296766 | A1 | 12/2011 | Sung |
| 2012/0192499 | A1 | 8/2012 | Sung |
| 2012/0241943 | A1 | 9/2012 | Sung |
| 2012/0244790 | A1 | 9/2012 | Sung |
| 2012/0260582 | A1 | 10/2012 | Sung |
| 2012/0302146 | A1 | 11/2012 | Sung |
| 2013/0225052 | A1 | 8/2013 | Song et al. |
| 2013/0244552 | A1 | 9/2013 | Lee et al. |
| 2014/0099868 | A1 | 4/2014 | Sung |

FOREIGN PATENT DOCUMENTS

| | | |
|---|---|---|
| EP | 0712941 | 5/1966 |
| EP | 0238434 | 3/1987 |
| EP | 0280657 | 8/1988 |
| EP | 0331344 | 2/1989 |
| EP | 0264674 | 9/1995 |
| EP | 1075898 | 2/2001 |
| GB | 2239011 | 6/1991 |
| GB | 2366804 | 3/2002 |
| JP | 06182184 | 4/1994 |
| JP | 10128654 | 5/1998 |
| JP | 10180618 | 7/1998 |
| JP | 11048122 | 2/1999 |
| JP | 11077536 | 3/1999 |
| JP | 2000/167774 | 6/2000 |
| JP | 2000/343436 | 12/2000 |
| JP | 2003/071718 | 3/2003 |
| JP | 2004/025401 | 1/2004 |
| JP | 2007/044823 | 2/2007 |
| KR | 10/2002/0036138 | 5/2002 |
| KR | 20/0339181 | 1/2004 |
| KR | 10/2007/0063569 | 6/2007 |
| WO | WO 94/27883 | 12/1994 |
| WO | WO 95/27596 | 10/1995 |
| WO | WO 95/31006 | 11/1995 |
| WO | WO 96/06732 | 3/1996 |
| WO | WO 98/10897 | 3/1998 |
| WO | WO 98/45091 | 3/1998 |
| WO | WO 98/51448 | 3/1998 |
| WO | WO 98/45092 | 10/1998 |
| WO | WO 02/31078 | 4/2002 |
| WO | WO 2004/094106 | 11/2004 |
| WO | WO 2006/039413 | 4/2006 |
| WO | WO 2006/124792 | 11/2006 |
| WO | WO 2007/032946 | 3/2007 |
| WO | WO 2008/063599 | 5/2008 |
| WO | WO 2009/043058 | 4/2009 |

(56) References Cited

FOREIGN PATENT DOCUMENTS

| | | |
|---|---|---|
| WO | WO 2009/064677 | 5/2009 |
| WO | WO 2012/040374 A2 | 3/2012 |

OTHER PUBLICATIONS

Endecott's Specifications; 2004.
Kennametal Specification for DMHPM002 Hot Press Matrix N-50 Dec. 6, 2001.
Material Safety Data Sheet (MSDS), Wall Colmonoy Corporation; prepared Jul. 20, 1989.
Material Safety Data Sheet MSDS); Kennametal; issued Jun. 11, 2004.
Sung et al.; The Eastern Wind of Diamond Symthesis; New Diamond and Frontier Carpon Technology; 2003; pp. 47-61; vol. 13, No. 1.
Sung et al; Mechanism of the Solvent-Assisted Graphite to Diamond Transition Under High Pressure: Implications for the Selection of Catalysts, High Temperatures-High Pressure; 1995/1996; pp. 523-546; vol. 27/28.
Syndite, CTM302; Announcement, Elementsix Advancing Diamond; Jan. 14, 2003; http://www.e6.com/en/resourches/announcementsheets/CTM302.pdf; as accessed on Dec. 16, 2008.
Yasunaga et al; Advances in Abrasive Technology, III; Soc. of Grinding Engineers (SGE) in Japan; 2000. (Abstract Only).

* cited by examiner

SYSTEM FOR EVALUATING AND/OR IMPROVING PERFORMANCE OF A CMP PAD DRESSER

PRIORITY DATA

This application is a continuation of United States patent application Ser. No. 12/850,747, filed Aug. 5, 2010, which claims the benefit of U.S. Provisional Patent Application Ser. No. 61/246,816, filed on Sep. 29, 2009, which is incorporated herein by reference.

FIELD OF THE INVENTION

The present invention relates generally to CMP pad conditioners used to remove material from (e.g., smooth, polish, dress, etc.) CMP pads. Accordingly, the present invention involves the fields of chemistry, physics, and materials science.

BACKGROUND OF THE INVENTION

The semiconductor industry currently spends in excess of one billion U.S. Dollars each year manufacturing silicon wafers that must exhibit very flat and smooth surfaces. Known techniques to manufacture smooth and even-surfaced silicon wafers are plentiful. The most common of these involves the process known as Chemical Mechanical Polishing (CMP) which includes the use of a polishing pad in combination with an abrasive slurry. Of central importance in all CMP processes is the attainment of high performance levels in aspects such as uniformity of polished wafer, smoothness of the IC circuitry, removal rate for productivity, longevity of consumables for CMP economics, etc.

SUMMARY OF THE INVENTION

The present invention provides methods and systems for evaluating and increasing CMP pad dresser performance. In one aspect, for example, a method of identifying overly-aggressive superabrasive particles in a CMP pad dresser is provided. Such a method can include positioning a CMP pad dresser having a plurality of superabrasive particles on an indicator substrate such that at least a portion of the plurality of superabrasive particles of the CMP pad dresser contact the indicator substrate. The method can further include moving the CMP pad dresser across the indicator substrate in a first direction such that the portion of the plurality of superabrasive particles create a first marking pattern on the substrate, wherein the first marking pattern identifies a plurality of working superabrasive particles from among the plurality of superabrasive particles. In another aspect, the method can include moving the CMP pad dresser in a second direction across the indicator substrate such that the portion of the plurality of superabrasive particles create a second marking pattern, the second direction being substantially transverse to the first direction, wherein the second marking pattern compared with the first marking pattern provides orientation information of the plurality of working superabrasive particles. Additionally, in one aspect, the plurality of superabrasive particles have at least one alignment orientation direction with respect to the CMP pad dresser, and the first direction is not the at least one alignment orientation.

It can also be beneficial to physically mark the plurality of working superabrasive particles on the CMP pad dresser. In one aspect, therefore, the indicator substrate can include an indicator marker to marks the plurality of working superabrasive particles as the CMP pad dresser is moved across the indicator substrate. Various indicator markers are contemplated, and any indicator marker capable of marking an overly-aggressive superabrasive particle should be considered to be within the present scope. Non-limiting examples include pigment markers, fluorescent markers, chemical markers, radioactive markers, and the like.

In another aspect of the present invention, a method of increasing a proportion of working superabrasive particles in a CMP pad dresser is provided. Such a method can include positioning a CMP pad dresser having a plurality of superabrasive particles on an indicator substrate such that at least a portion of the plurality of superabrasive particles of the CMP pad dresser contact the indicator substrate, and moving the CMP pad dresser across the indicator substrate in a first direction such that the portion of the plurality of superabrasive particles create a first marking pattern on the substrate. The first marking pattern identifies a plurality of overly-aggressive superabrasive particles from among the plurality of superabrasive particles. The method can also include ablating at least a portion of the plurality of overly-aggressive superabrasive particles to increase the proportion of working superabrasive particles in the CMP pad dresser.

The method can further include identifying subsequent working superabrasive particles following the ablation procedure. Accordingly, in one aspect, the CMP pad dresser can be positioned on a subsequent indicator substrate such that at least a portion of the plurality of superabrasive particles of the CMP pad dresser contact the subsequent indicator substrate. The CMP pad dresser can then be moved across the subsequent indicator substrate in the first direction such that the portion of the plurality of superabrasive particles create a subsequent marking pattern on the substrate, where the subsequent marking pattern identifies a subsequent plurality of working superabrasive particles from among the plurality of superabrasive particles.

The present invention additionally provides a CMP pad dresser conditioning profile. Such a conditioning profile can include a dressing pattern identifying a plurality of working superabrasive particles from a plurality of superabrasive particles of the CMP pad dresser. A variety of formats of dressing patterns are contemplated, and any format of conveying relevant information would be considered to be within the present scope. Non-limiting examples can include an electronic representation, a marking pattern on an indicator substrate, a graphical representation of a marking pattern, a numerical representation of a marking pattern, a CMP pad dresser map showing locations of the plurality of working superabrasive particles, and the like. In one specific aspect, the dressing pattern is a marking pattern on an indicator substrate including a first marking pattern created by the plurality of working superabrasive particles moving across the indicator substrate in a first direction, and further including a second marking pattern created by the plurality of working superabrasive particles moving across the indicator substrate in a second direction. The second direction can be at least substantially transverse to the first direction.

The present invention additionally provides a method of leveling tips of a plurality of superabrasive particles in a CMP pad dresser. In one aspect, such a method can include temporarily coupling a plurality of superabrasive particles to a tool substrate and positioning the plurality of superabrasive particles against an indicator substrate such that at least a portion of the plurality of superabrasive particles contact the indicator substrate. The method can further include moving the plurality of superabrasive particles across the indicator substrate such that the portion of the plurality of superabrasive particles creates a marking pattern on the indicator substrate. The marking pattern identifies a plurality of overly-aggressive superabrasive particles from among the plurality of superabrasive particles. The method can also include adjusting tips of the plurality of overly-aggressive superabrasive particles relative to the tool substrate to vary a proportion of working superabrasive particles to non-working superabrasive particles, and permanently coupling the plurality of superabrasive particles to the tool substrate.

Although a variety of methods of permanently coupling superabrasive particles to a substrate are contemplated, in one aspect the plurality of superabrasive particles are permanently coupled to the tool substrate with an organic matrix. Non-limiting examples of organic matrix materials include amino resins, acrylate resins, alkyd resins, polyester resins, polyamide resins, polyimide resins, polyurethane resins, phenolic resins, phenolic/latex resins, epoxy resins, isocyanate resins, isocyanurate resins, polysiloxane resins, reactive vinyl resins, polyethylene resins, polypropylene resins, polystyrene resins, phenoxy resins, perylene resins, polysulfone resins, acrylonitrile-butadiene-styrene resins, acrylic resins, polycarbonate resins, polyimide resins, and combinations thereof.

The present invention additionally provides a system for identifying working superabrasive particles in a CMP pad dresser. Such a system can include an indicator substrate and a CMP pad dresser having a plurality of superabrasive particles, where a portion of the plurality of superabrasive particles is in contact with the indicator substrate. The system can further include a marking pattern cut into the indicator substrate by the portion of the plurality of superabrasive particles, where the marking pattern identifies a plurality of working superabrasive particles from among the plurality of superabrasive particles.

The present invention also provides a method for identifying working superabrasive particles in a CMP pad dresser. Such a method can include pressing a plastic sheet suspended within a frame onto a CMP pad dresser having a plurality of superabrasive particles such that the plastic sheet is deformed by at least a portion of the plurality of superabrasive particles. The deformed plastic sheet can then be observed to identify a plurality of working superabrasive particles from among the plurality of superabrasive particles. In some aspects, the plastic sheet can be at least semi-reflective to facilitate the identification of the plurality of working superabrasive particles.

There has thus been outlined, rather broadly, various features of the invention so that the detailed description thereof that follows may be better understood, and so that the present contribution to the art may be better appreciated. Other features of the present invention will become clearer from the following detailed description of the invention, taken with any accompanying or following claims, or may be learned by the practice of the invention.

Figure 1:
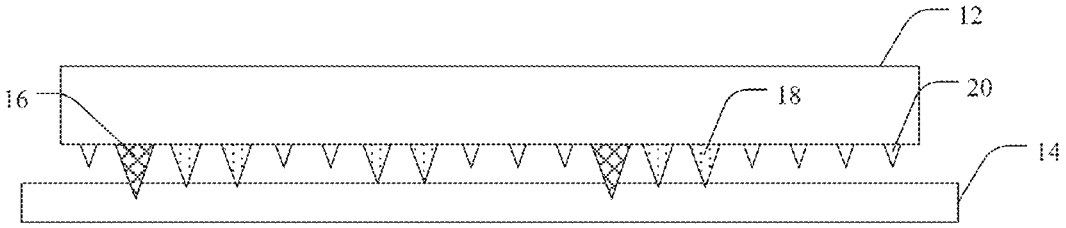
FIG. 1 is a cross section view of a CMP pad dresser disposed on an indicator substrate in accordance with an embodiment of the present invention.

It will be understood that the above figures are merely for illustrative purposes in furthering an understanding of the invention. Further, the figures may not be drawn to scale, thus dimensions, particle sizes, and other aspects may, and generally are, exaggerated to make illustrations thereof clearer. Therefore, it will be appreciated that departure can and likely will be made from the specific dimensions and aspects shown in the figures.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and any appended or following claims, the singular forms "a," "an" and "the" include plural referents unless the context clearly dictates otherwise. Thus, for example, reference to "a superabrasive particle" can include one or more of such particles.

Definitions

In describing and claiming the present invention, the following terminology will be used in accordance with the definitions set forth below.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free" of an ingredient or element may still actually contain such item as long as there is no measurable effect thereof.

As used herein, "working superabrasive particles" are superabrasive particles that touch a CMP pad during a dressing or conditioning procedure. This touching can remove debris from the surface, it can deform the surface either elastically or plastically, or it can cut the surface to create a groove. In one specific aspect, a working superabrasive particle can cut deeper than about 10 microns into a CMP pad during a dressing procedure.

As used herein, "non-working superabrasive particles" are superabrasive particles in a CMP pad dresser that do not significantly touch the pad sufficient to remove debris from the surface, deform the surface, cut the surface to create a groove.

As used herein, "overly-aggressive superabrasive particles" are superabrasive particles in a CMP pad dresser that aggressively dress or condition a CMP pad. In one aspect, aggressive superabrasive particles are superabrasive particles that cut deeper than about 50 microns into a CMP pad during a dressing procedure. In another aspect, aggressive superabrasive particles are superabrasive particles that remove at least ⅓ of the material from the CMP pad. In yet another aspect, aggressive superabrasive particles are superabrasive particles that remove at least ½ of the material from the CMP pad.

As used herein, "indicator substrate" refers to a substrate material upon which a portion of the superabrasive particles of a CMP pad dresser can be positioned and moved to make markings indicative of working superabrasive particles.

As used herein, "marking pattern" refers to a pattern on an indicator substrate created by moving superabrasive particles thereacross. The markings can be any detectable marking known, including cuts, scratches, depressions, material deposition (e.g. pigment markers, chemical markers, fluorescent markers, radioactive markers, etc.).

As used herein, "transverse" refers to a directional orientation that is cross-wise to a reference axis. In one aspect, "transverse" can include a directional orientation that is at least at a substantial right angle to the reference axis.

As used herein, "alignment orientation direction" refers to the direction of an alignment axis of the plurality of superabrasive particles. For example, a plurality of superabrasive particles aligned in a grid formation would have at least two alignment axes; an alignment axis in the column direction and an alignment axis in the row direction oriented 90° to the column direction.

As used herein, "ablate" or "ablating" refer to a process of removing a superabrasive particle from a CMP pad dresser or reducing the projection of a superabrasive particle thus reducing the degree of contact between the superabrasive particle and the indicator substrate.

As used herein, "superabrasive segment" refers to a tool body having multiple superabrasive particles associated therewith. In some aspect, a superabrasive segment can include superabrasive polycrystalline materials as cutting elements.

As used herein, a "tool substrate" refers a portion of a pad conditioner that supports abrasive materials, and to which abrasive materials and/or superabrasive segments that carry abrasive materials may be affixed. Substrates useful in the present invention may of a variety of shapes, thicknesses, or materials that are capable of supporting abrasive materials in a manner that is sufficient to provide a pad conditioner useful for its intended purpose. Substrates may be of a solid material, a powdered material that becomes solid when processed, or a flexible material. Examples of typical substrate materials include without limitation, metals, metal alloys, ceramics, relatively hard polymers or other organic materials, glasses, and mixtures thereof. Further, the substrate may include a material that aids in attaching abrasive materials to the substrate, including, without limitation, brazing alloy material, sintering aids and the like.

As used herein, "superabrasive" may be used to refer to any crystalline, or polycrystalline material, or mixture of such materials which has a Mohr's hardness of about 8 or greater. In some aspects, the Mohr's hardness may be about 9.5 or greater. Such materials include but are not limited to diamond, polycrystalline diamond (PCD), cubic boron nitride (cBN), polycrystalline cubic boron nitride (PcBN), corundum and sapphire, as well as other superhard materials known to those skilled in the art. Superabrasive materials may be incorporated into the present invention in a variety of forms including particles, grits, films, layers, pieces, segments, etc. In some cases, superabrasive materials are in the form of polycrystalline superabrasive materials, such as PCD and PcBN materials.

As used herein, "organic matrix" or "organic material" refers to a semisolid or solid complex or mix of organic compounds. As such, "organic material layer" and "organic material matrix" may be used interchangeably, refer to a layer or mass of a semisolid or solid complex amorphous mix of organic compounds, including resins, polymers, gums, etc. Preferably the organic material will be a polymer or copolymer formed from the polymerization of one or more monomers. In some cases, such organic material may be adhesive.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The Invention

A CMP pad dresser is used to dress or condition a CMP pad, and by doing so reconditions the pad by removing dirt and debris, as well as opening up asperities in the pad surface to capture and hold chemical slurry during a polishing procedure. Due to difficulties associated with superabrasive particle leveling, only a small percentage of superabrasive particles in a CMP pad dresser are positioned so as to penetrate or cut into a CMP pad. As this small percentage of superabrasive particles become worn, plastic deformation of the CMP pad becomes large relative to the amount CMP of pad that is cut. Consequently, the pad becomes highly deformed and accumulated with dirt. As a result the polishing rate of the CMP pad declines, and the scratch rate of the wafer or workpiece increases.

The inventor has discovered novel techniques to identify a cutting profile for a CMP pad dresser that can include the number and location of non-working, working, and overly-aggressive superabrasive particles. From such a profile, the cutting effectiveness of a CMP pad dresser can be determined. The technique can be performed on both used and unused CMP pad dressers.

CMP pads are typically made of a relatively soft polymer, such as polyurethane. As the CMP pad is engaged by the CMP pad dresser, the polymer material is deformed first by elastic strain and then by plastic strain. Eventually, the strain energy in the deformed material exceeds the bond energy density (i.e. the hardness of the pad) and the polymer material ruptures. Thus, the function of superabrasive particles in the CMP pad dresser is to dress the CMP pad material by breaking polymeric bonds through this deformation process. It should be noted that sharp superabrasive particle tips can penetrate the CMP pad material without causing excessive deformation. As such, the sharpness of a superabrasive particle can be defined as being inverse to the deformed volume prior to rupture. In other words, the smaller the volume of deformation prior to cutting, the sharper the cutting tip. This deformation information can be used to determine the sharpness of superabrasive particles in the CMP pad dresser.

Additionally, a superabrasive particle having a tip with smaller tip radius, such as would be the case with a broken corner, can cut more cleanly through the CMP pad with less deformation as compared to a superabrasive particle having a larger tip radius. Consequently, an irregularly shaped superabrasive particle tip can be sharper than a euhedral superabrasive corner having an obtuse angle relative to the CMP pad. This also applies to the difference between a superabrasive particle corner as compared with a superabrasive particle face.

It is thus noted that sharp superabrasive particle tips can cut CMP pad materials with less deformation and material strain. Conversely, a dull superabrasive particle may deform but not cut the CMP pad material because the strain energy does not exceed the bond energy density of the polymeric material. As the tips of such particles are worn, the contact area between the polymeric material and the particles increase. This increase in contact area results in an increase in the deformation volume of the pad. Due to the increased strain energy required for the polymeric material to rupture with such an increased deformation volume, the number of superabrasive particles cutting the polymeric material will decrease in relation to the degree of dulling during a CMP process.

CMP pad dressing can also be affected by the proportion of superabrasive particles in the CMP pad dresser that are working and the proportion that are overly-aggressively cutting. As an example, a typical CMP pad dresser can have greater than 10,000 superabrasive particles. Of these 10,000 particles, in some cases there may only be about 100 working superabrasive particles that are actually able to cut the CMP pad. Additionally, out of the 100 working superabrasive particles, there may be approximately 10 overly-aggressive superabrasive particles that cut over 50% of the entire pad that is consumed during conditioning, and in some cases can remover more that 25% of the total pad material. This uneven work load distribution can cause erratic CMP performance, and can result in over consumption of the CMP pad, chipping of the overly-aggressive superabrasive particles that can scratch the wafer, unpredictable wafer removal rates, uneven wafer surface planarization, shortened CMP pad dresser life, compaction of the CMP pad with debris, and the like.

Accordingly, a method of identifying overly-aggressive superabrasive particles in a CMP pad dresser is provided. Such a method can include positioning a CMP pad dresser having a plurality of superabrasive particles on an indicator substrate such that at least a portion of the plurality of superabrasive particles of the CMP pad dresser contact the indicator substrate, and moving the CMP pad dresser across the indicator substrate in a first direction such that the portion of the plurality of superabrasive particles create a first marking pattern on the substrate. As such, the first marking pattern identifies a plurality of working superabrasive particles from among the plurality of superabrasive particles.

Traditional superabrasive particle tip leveling methods have typically measured the height of such tips from the backside of the CMP pad dresser. Such a measurement may not provide an accurate estimation of the degree of leveling of superabrasive particle tips in relation to the CMP pad due to variations in the thickness of the CMP pad dresser substrate and variation that arises during the manufacturing process. Additionally, the CMP pad dresser may not be precisely parallel to the surface of the CMP pad during dressing. Thus tip height variations measured at the tips of the superabrasive particles can provide a more accurate cutting profile.

Accordingly, a CMP pad dresser can be pressed against an indicator substrate with a fixed load, and moved across the substrate to create a cutting pattern. Thus the superabrasive particles that are in contact with the indicator substrate will deflect and then penetrate the substrate in proportion to their tip height, sharpness, etc. As is shown in FIG. 1, for example, a CMP pad dresser 12 is pressed into an indicator substrate 14 with a fixed load. Overly-aggressive superabrasive particles 16 penetrate into the indicator substrate 14 the furthest, followed by the working superabrasive particles 18 that penetrate to a lesser extent as compared to the overly-aggressive superabrasive particles. Non-working superabrasive particles 20 are shown that do not significantly penetrate the indicator substrate 14.

Figure 2:
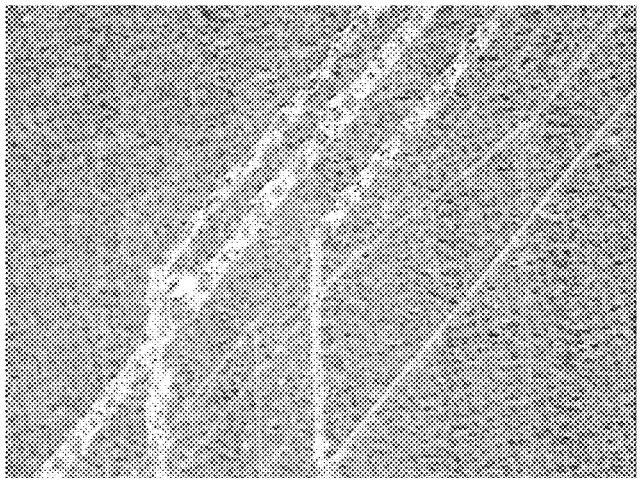
FIG. 2 is an image of a marking pattern on an indicator substrate according to another embodiment of the present invention.

The CMP pad dresser can then be moved across the surface of the indicator substrate to create a scratch pattern as is shown in FIG. 2. Superabrasive particles will scratch the indicator substrate to an extent that is related to the projection and sharpness of the particles. The direction of movement can be any direction, but in some aspects it can be beneficial to move the CMP pad dresser in a direction that does not correspond with an alignment orientation of the plurality of superabrasive particles. In other words, if a CMP pad dresser has superabrasive particles that are oriented in a grid, movement of the CMP pad dresser across the indicator substrate should not be in a direction that aligns with the superabrasive particle grid. This is because many superabrasive particles will align along the same groove pattern on the indicator substrate and it will be very difficult to tell which or even how many superabrasive particles contacted the indicator substrate to cause the scratch pattern.

In one aspect, the CMP pad dresser can be moved in a second direction across the indicator substrate such that the portion of the plurality of superabrasive particles creates a second marking pattern. The second should be substantially transverse to the first direction. It is intended that a direction that is transverse to a reference direction be defined as any direction that is crosswise to the reference. Thus crosswise can include any direction that crosses the reference direction. In one aspect, transverse can be perpendicular to. In another aspect, transverse can be any angle between 0° and 90° with respect to the reference. Non-limiting examples can include 10°, 30°, 45°, 60°, and the like. Among other informational content, the second marking pattern compared with the first marking pattern can provide orientation information of the plurality of working superabrasive particles. Thus as an example, a superabrasive particle that cuts a wider line in the first direction than the second direction may be cutting with an edge or a face in the first direction and with a tip in the second direction. As can be seen in FIG. 2, the point where scratch lines change direction show where the CMP pad dresser direction was changed from the first direction to the second direction. It should also be noted that, as with the first direction, it can be beneficial for the second direction to not correspond with an alignment orientation of the plurality of superabrasive particles.

Various indicator substrate materials are contemplated, and it should be noted that any material capable of performing in accordance with aspects of the present should be considered to be within the present scope. Non-limiting examples can include materials such as plastics or other polymers, waxes, crystalline materials, ceramics, and the like. One specific example of a polymeric indicator substrate is a polyethylene terephthalate (PET) transparency. It is also contemplated that pressure sensitive electronic displays could also be utilized as an indicator substrate according to aspects of the present invention.

In one aspect, the indicator substrate can include an indicator marker to create markings on superabrasive particles that scratch the indicator substrate as the dresser is moved across the substrate. This can allow the working and/or overly-aggressive superabrasive particles to be more easily identified on the CMP pad dresser. Various indicator markers are contemplated, including, without limitation, pigment and ink markers, fluorescent markers, chemical markers, radioactive markers, and the like. As an example, a pigment can be printed on the surface of a PET transparency using a conventional printer. Superabrasive particles scratching the pigment-coated surface of the transparency are marked by the pigment and can thus be more readily identified on the surface of the CMP pad dresser.

In another aspect, the present invention additionally provides a method of increasing a proportion of working superabrasive particles in a CMP pad dresser. Such a method can include positioning a CMP pad dresser having a plurality of superabrasive particles on an indicator substrate such that at least a portion of the plurality of superabrasive particles of the CMP pad dresser contact the indicator substrate and moving the CMP pad dresser across the indicator substrate in a first direction such that the portion of the plurality of superabrasive particles create a first marking pattern on the substrate. As has been discussed, the first marking pattern identifies a plurality of working superabrasive particles from among the plurality of superabrasive particles. The method can also include identifying a plurality of overly-aggressive superabrasive particles from the plurality of working superabrasive particles. Such identification can be readily accomplished via the examination of the scratch pattern characteristics of the marking pattern. Subsequently, the method can include ablating at least a portion of the plurality of overly-aggressive superabrasive particles to increase the proportion of working superabrasive particles in the CMP pad dresser.

Figure 3:
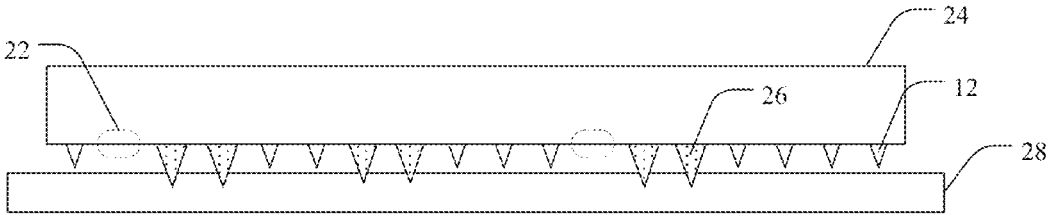
FIG. 3 is a cross section view of a CMP pad dresser disposed on an indicator substrate in accordance with yet another embodiment of the present invention.

As is shown in FIG. 3, the effects of the ablation of overly-aggressive superabrasive particles 22 from a CMP pad dresser 24 can function to increase the number of working superabrasive particles 26 and the depth to which these superabrasive particles can penetrate into the indicator substrate 28 (compare with FIG. 1). By ablating the superabrasive particles having the highest protrusion, i.e. the overly-aggressive superabrasive particles 22, a greater proportion of working superabrasive particles 26 are allowed to contact the indicator substrate 28, and thus a greater number of superabrasive particles are able to condition a CMP pad during a dressing operation.

Ablating a superabrasive particle can occur by a variety of techniques, and any technique capable of selectively ablating such a particle should be considered to be within the present scope. For example, a vibrating needle or other structure can be used to ablate a specific superabrasive particle. Superabrasive particles, such as diamonds, tend to be brittle, and thus will break using such a technique. Superabrasive particles can similarly be ablated using a laser. Also, CMP pad dressers utilizing a thermoplastic resin as a support matrix can be heated locally around the superabrasive particle, and the particle can be pulled from the matrix.

Note, however, that non-working superabrasive particles 30 are present in the CMP pad dresser. In some aspects conditioning of a CMP pad can be improved by having a proportion of the overall plurality of superabrasive particles be non-working. This situation provides space between the working crystals for the movement of the slurry and for the expulsion of dirt and debris. Thus it can be beneficial to increase the number of working superabrasive particles in a CMP pad dresser while still leaving a proportion of non-working superabrasive particles to allow for slurry, dirt, and debris movement.

The ablation procedure can also be utilized to extend the life of a CMP pad dresser. Because the most overly-aggressive cutting superabrasive particles are a minority of the total number of superabrasive particles in a CMP pad dresser, and because aggressive and overly-aggressive cutting tends to dull particles more quickly, a dresser that has a decreased effectiveness can actually appear to be an unused or slightly used tool. This is because the wear on the superabrasive particles, including the non-overly aggressive particles, may not be apparent. By creating a marking pattern for such a CMP pad dresser on an indicator substrate, the now dulled overly-aggressive or overly-aggressive particles can be identified. Ablating these dulled superabrasive particles allows sharper working superabrasive particles to now interact more effectively with the CMP pad, thus extending the life or "reconditioning" the dresser.

Following ablation of all or some of the overly-aggressive superabrasive particles, a conditioning profile can again be generated by following the above procedures. For example, in one aspect, the CMP pad dresser can be positioned on a subsequent indicator substrate such that at least a portion of the plurality of superabrasive particles of the CMP pad dresser contact the subsequent indicator substrate, and the CMP pad dresser can be moved across the subsequent indicator substrate in the first direction such that the portion of the plurality of superabrasive particles create a subsequent marking pattern on the substrate. As with the previous aspects, the subsequent marking pattern identifies a subsequent plurality of working superabrasive particles from among the plurality of superabrasive particles. It should also be noted that, rather than using a subsequent indicator substrate, in some aspects the previous indicator substrate can be used to compare the cutting pattern of the previous superabrasive particle configuration with the subsequent superabrasive particle configuration. Additionally, such a comparison can be made using separate indicator substrates by comparing the scratch patterns. For example, two PET transparencies can be aligned parallel to one another such that the two marking patterns can be compared.

The techniques according to the various aspects of the present invention can be utilized with numerous types of CMP pad dressers. For example, in one aspect, the superabrasive particles can be single crystal superabrasive particles, such as natural or synthetic diamond, cubic boron nitride, and the like. In another aspect, the superabrasive particles can be polycrystalline particles, such as polycrystalline diamond, polycrystalline cubic boron nitride etc. In yet another aspect, the superabrasive particles can be superabrasive segments having an abrasive layer disposed thereon, wherein the abrasive layer can be include single crystal material, polycrystalline material, or a combination thereof. Additionally, CMP pad dressers can include matrix materials such as brazed metals, organic polymers, sintered metals, ceramics, and the like. Examples of various CMP pad dressers can be found in U.S. Pat. No. 6,039,641, filed on Apr. 4, 1997; U.S. Pat. No. 6,193,770, filed on Nov. 4, 1998; U.S. Pat. No. 6,286,498, filed on Sep. 20, 1999; U.S. Pat. No. 6,679,243, filed on Aug. 22, 2001; U.S. Pat. No. 7,124,753, filed on Apr. Sep. 27, 2002; U.S. Pat. No. 6,368,198, filed on Apr. 26, 2000; U.S. Pat. No. 6,884,155, filed on Mar. 27, 2002; U.S. Pat. No. 7,201,645, filed on Sep. 29, 2004; and U.S. Pat. No. 7,258,708, filed on Dec. 30, 2004, each of which are hereby incorporated herein by reference. Additionally, examples of various CMP pad dressers can be found in U.S. patent application Ser. No. 11/357,713, filed on Feb. 17, 2006; Ser. No. 11/560,817, filed on Nov. 16, 2006; Ser. No. 11/786,426, filed on Apr. 10, 2007; Ser. No. 11/223,786, filed on Sep. 9, 2005; Ser. No. 11/804,221, filed on May 16, 2007; Ser. No. 11/724,585, filed on Mar. 14, 2007; Ser. No. 12/267,172, filed on Nov. 7, 2008; Ser. No. 11/940,935, filed on Nov. 15, 2007; Ser. No. 12/168,110, filed on Jul. 5, 2008; and Ser. No. 12/255,823, filed on Oct. 22, 2008, each of which are hereby incorporated herein by reference.

In another aspect of the present invention, a CMP pad dresser conditioning profile is provided. Such a profile can include a dressing pattern identifying a plurality of working superabrasive particles and/or a plurality of overly-aggressive superabrasive particles from the total plurality of superabrasive particles of a CMP pad dresser. The dressing pattern can be provided in a number of formats, and it should be understood that the present scope includes all such formats. Non-limiting examples include an electronic representation, a marking pattern on an indicator substrate, a graphical representation of a marking pattern, a numerical representation of a marking pattern, a CMP pad dresser map showing locations of the plurality of working superabrasive particles, and combinations thereof. In one specific aspect, the dressing pattern is a marking pattern on an indicator substrate. Such a marking pattern can include a first marking pattern created by the plurality of working superabrasive particles moving across the indicator substrate in a first direction and a second marking pattern created by the plurality of working superabrasive particles moving across the indicator substrate in a second direction. Such a CMP pad dresser conditioning profile can be useful in correlating the superabrasive particles on a CMP pad dresser with the performance of the dresser during a CMP polishing procedure. Such a profile can be provided with a new dresser, it can be created using a new dresser, or it can be made during the service life of a dresser.

The present invention additionally provides a system for identifying working superabrasive particles in a CMP pad dresser. Such a system can include an indicator substrate and a CMP pad dresser having a plurality of superabrasive particles, where a portion of the plurality of superabrasive particles is in contact with the indicator substrate. The system can additionally include a marking pattern cut into the indicator substrate by the portion of the plurality of superabrasive particles, where the marking pattern identifies a plurality of working superabrasive particles from among the plurality of superabrasive particles. As has been described above, the indicator substrate can include an indicator marker to mark the plurality of working superabrasive particles.

The techniques of the present invention can also be used in the manufacture of CMP pad dressers. In one aspect, for example, a method of leveling tips of a plurality of superabrasive particles in a CMP pad dresser is provided. Such a method can include temporarily coupling a plurality of superabrasive particles to a tool substrate, positioning the plurality of superabrasive particles against an indicator substrate such that at least a portion of the plurality of superabrasive particles contact the indicator substrate, and moving the plurality of superabrasive particles across the indicator substrate such that the portion of the plurality of superabrasive particles creates a marking pattern on the indicator substrate. The marking pattern can thus identify overly-aggressive superabrasive particles from among the plurality of superabrasive particles. The projection of the overly-aggressive superabrasive particles can then be adjusted relative to the tool substrate to vary the proportion of working superabrasive particles to non-working superabrasive particles present in the tool. The leveling process can be repeated as necessary. Following leveling, the plurality of superabrasive particles can be permanently coupled to the tool substrate. By adjusting the proportion of working superabrasive particles prior to permanently fixing the particles into the CMP pad dresser, improved conditioning performance can be achieved.

The present invention additionally provides a method for identifying working superabrasive particles in a CMP pad dresser whereby the identifying of the particles occurs on the dresser. In one aspect, for example, such a method can include pressing a plastic sheet suspended within a frame onto a CMP pad dresser having a plurality of superabrasive particles, such that the plastic wrap is deformed by at least a portion of the plurality of superabrasive particles. Subsequently, the deformed plastic sheet can be observed to identify a plurality of working superabrasive particles from among the plurality of superabrasive particles. In other words, because the plastic sheet is stretched across the frame, deformations in the plastic sheet once it has been pressed onto a CMP pad dresser will have a deformation size that corresponds to the protrusion of the superabrasive particles. Thus particles that are more overly-aggressive and thus protrude further from the CMP pad dresser will create bigger deformations in the plastic sheet. The plastic sheet can then be marked to indicate the location of the overly-aggressive particles. Additionally, in one aspect, the plastic sheet can be at least semi-reflective to facilitate the identification of the working and overly-aggressive superabrasive particles.

It is to be understood that the above-described arrangements are only illustrative of the application of the principles of the present invention. Numerous modifications and alternative arrangements may be devised by those skilled in the art without departing from the spirit and scope of the present invention and any appended or following claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of identifying overly-aggressive superabrasive particles in a CMP pad dresser, comprising:

positioning a CMP pad dresser having a plurality of superabrasive particles on an indicator substrate such that at least a portion of the plurality of superabrasive particles of the CMP pad dresser contact the indicator substrate;

pressing the CMP pad dresser against the indicator substrate with a fixed load; and moving the CMP pad dresser across the indicator substrate in a first direction such that the portion of the plurality of superabrasive particles create a first marking pattern on the substrate, wherein the first marking pattern identifies a plurality of working superabrasive particles from among the plurality of superabrasive particles.

2. The method of claim 1, further comprising moving the CMP pad dresser in a second direction across the indicator substrate such that the portion of the plurality of superabrasive particles create a second marking pattern, the second direction being substantially transverse to the first direction, wherein the second marking pattern compared with the first marking pattern provides orientation information of the plurality of working superabrasive particles.

3. The method of claim 1, wherein the indicator substrate includes an indicator marker that marks the plurality of working superabrasive particles as the CMP pad dresser is moved across the indicator substrate.

4. The method of claim 3, wherein the indicator marker includes a member selected from the group consisting of pigment markers, fluorescent markers, chemical markers, radioactive markers, and combinations thereof.

5. The method of claim 1, wherein the plurality of superabrasive particles have at least one alignment orientation direction with respect to the CMP pad dresser, and wherein the first direction is not the at least one alignment orientation.

6. The method of claim 1, further comprising identifying and ablating overly-aggressive superabrasive particles from the plurality of working superabrasive particles.

7. The method of claim 6, further comprising:

positioning the CMP pad dresser on a subsequent indicator substrate such that at least a portion of the plurality of superabrasive particles of the CMP pad dresser contact the subsequent indicator substrate; and moving the CMP pad dresser across the subsequent indicator substrate in the first direction such that the portion of the plurality of superabrasive particles create a subsequent marking pattern on the substrate, wherein the subsequent marking pattern identifies a subsequent plurality of superabrasive particles from among the plurality of superabrasive particles.

8. The method of claim 1, wherein the plurality of superabrasive particles is a plurality of superabrasive segments, and the plurality of working superabrasive particles is a plurality of working superabrasive segments.

9. A method of increasing a proportion of working superabrasive particles in a CMP pad dresser, comprising:

positioning a CMP pad dresser having a plurality of superabrasive particles on an indicator substrate such that at least a portion of the plurality of superabrasive particles of the CMP pad dresser contact the indicator substrate;

pressing the CMP pad dresser against the indicator substrate under a fixed load;

moving the CMP pad dresser across the indicator substrate in a first direction such that the portion of the plurality of superabrasive particles create a first marking pattern on the substrate, wherein the first marking pattern identifies a plurality of working superabrasive particles from among the plurality of superabrasive particles;

identifying a plurality of overly-aggressive superabrasive particles from the plurality of working superabrasive particles; and ablating at least a portion of the plurality of overly-aggressive superabrasive particles to increase the proportion of working superabrasive particles in the CMP pad dresser.

10. The method of claim 9, further comprising:

positioning the CMP pad dresser on a subsequent indicator substrate such that at least a portion of the plurality of superabrasive particles of the CMP pad dresser contact the subsequent indicator substrate; and moving the CMP pad dresser across the subsequent indicator substrate in the first direction such that the portion of the plurality of superabrasive particles create a subsequent marking pattern on the substrate, wherein the subsequent marking pattern identifies a subsequent plurality of working superabrasive particles from among the plurality of superabrasive particles.

11. A system for identifying working superabrasive particles in a CMP pad dresser, comprising:

an indicator substrate;

a CMP pad dresser having a plurality of superabrasive particles, wherein a portion of the plurality of superabrasive particles are pressed against the indicator substrate under a fixed load; and a marking pattern cut into the indicator substrate by the portion of the plurality of superabrasive particles, wherein the marking pattern identifies a plurality of working superabrasive particles from among the plurality of superabrasive particles.

12. The system of claim 11, wherein the indicator substrate includes an indicator marker to mark the plurality of working superabrasive particles.

13. The system of claim 12, wherein the indicator marker includes a member selected from the group consisting of pigment markers, fluorescent markers, chemical markers, radioactive markers, and combinations thereof.

* * * * *